US005884789A

United States Patent [19]

Gardner

[11] Patent Number: 5,884,789

[45] Date of Patent: Mar. 23, 1999

[54] CORK REMOVAL APPARATUS

[76] Inventor: William A. Gardner, 6950 Yount St., Yountville, Calif. 94599

[21] Appl. No.: 746,799

[22] Filed: Nov. 18, 1996

[51] Int. Cl.[6] ..... B65D 39/00

[52] U.S. Cl. ..... 215/299; 215/211; 215/215; 81/3.45

[58] Field of Search ..... 215/296, 297, 215/299, 364, 211, 215; 81/3.45, 3.48, 3.49

[56] References Cited

U.S. PATENT DOCUMENTS

| | | | |
|---|---|---|---|
| 773,857 | 11/1904 | Effenberger | 215/299 |
| 778,593 | 12/1904 | Maconnell | 215/299 |
| 884,322 | 4/1908 | Deusch | 215/299 |
| 1,204,712 | 11/1916 | Spelling . | |
| 1,416,616 | 5/1922 | Crane | 215/299 X |
| 1,464,646 | 8/1923 | Cross | 215/299 X |
| 3,307,727 | 3/1967 | Garay | 215/299 |
| 4,889,251 | 12/1989 | Hojnoski . | |

*Primary Examiner*—Stephen K. Cronin
*Attorney, Agent, or Firm*—John P. O'Banion

[57] ABSTRACT

An apparatus for removing a cork from a bottle in which an anchor is embedded in the cork and a cork-pulling handle is provided for engaging the anchor for removal of the cork. The cork-pulling handle can be connected to the anchor by any of several means, and can be stored with the bottle as an integral part of the bottle/label package or provided separately.

11 Claims, 6 Drawing Sheets

CORK REMOVAL APPARATUS

BACKGROUND OF THE INVENTION

1. Field of the Invention

This invention pertains generally to devices and methods for removing corks from bottles, and more particularly to a cork removal apparatus in which an anchor is integrated with the cork in the bottling process, in which the cork is extracted with a cork-pulling handle that is packaged with the bottle or provided separately, and in which the cork-pulling handle is coupled to the anchor during bottling or later by the consumer.

2. Description of the Background Art

Wine and a few other beverages are typically packaged in glass bottles that are sealed with a cork stopper. Although easy-open containers such as snap-top cans and screw-cap bottles are well known, there are several reasons why easy-open technologies have not been widely adopted in the wine industry. Two particularly salient reasons are that (i) the aesthetic appeal of corked bottles is important to wine consumers, and (ii) no completely adequate means for quick and easy removal of corks, without the use of awkward, cumbersome, or clumsy auxiliary cork removing devices (such as cork screws, cork pullers, pressure pumps, etc.), has yet been invented.

A completely adequate means for quick and easy removal of corks from wine bottles must meet four basic requirements. The first is that the cork must provide an adequate seal against the inside walls of the neck of the bottle. The second is that a permanently installed pulling device must not protrude through the bottom or sides of the cork and it must not split or tear the cork because of the likelihood of resultant wine leakage and/or wine contamination. The third is that the cork and cork-puller installation into the wine bottle must not unduly complicate the present bottle-corking technology used throughout the industry. The fourth is that the cork must be easily extractable by the consumer without the use of cumbersome, awkward, or clumsy auxiliary devices. These requirements, however, tend to work against each other.

For example, the better the cork/glass seal is, the harder it is to extract the cork: the pulling force can increase by as much as 20 kg or more due to the addition of adequate amounts of paraffin wax for sealing. The only known viable prior device for quick and easy cork removal without a separate apparatus is the "cork stopper for bottles of wine" described in U.S. Pat. No. 4,889,251 issued to Hojnoski on Dec. 26, 1989. The Hojnoski device comprises an integrated cork and puller that enables the wine consumer to quickly and easily remove the cork, provided that the cork is sufficiently well coated with a lubricating agent such as silicone. However, with adequate lubricant, the cork/glass seal obtained is not as good as it should be because it is not possible to use enough wax in the cork coating. That is, it is wax that provides a good cork/glass seal. However, wax acts counter to the silicone lubricant and makes the cork stick to the glass. Consequently, if enough wax is used to provide a good seal, the pull force required to extract the cork (which would normally be as high as 35 kg to 40 kg) using the Hojnoski device is too great. This results from the fact that Hojnoski uses a pulling device that is part of the cork unit, as desired, but because of this it is so small that only two fingers can be used for the pulling operation. With only two fingers, pulling forces in excess of about 20 kg would not be possible for many consumers. In addition, the Hojnoski device, by its nature, is too fragile to reliably withstand more than a pulling force of about 35 kg. This is due in part to a fundamental element of its design, namely the use of a hollow plastic cylinder for anchoring the cork, which enables the insertion of a pulling device into the anchor that can slide up and down to accommodate both operational and storage positions.

Another example of an attempt to provide a cork stopper with a self-contained pulling device can be seen in U.S. Pat. No. 1,204,712 issued to Spelling. There are several reasons why the Spelling device is not viable, including the fact that it is not designed for high-speed bottling/corking equipment, and the requirement of a degree of elasticity and tensile strength of the stopper that exceeds that of cork resulting in a significant likelihood of the cork splitting during corking and, as a result, the wine leaking and becoming subject to contamination.

Therefore there is a need for a self-contained cork and cork-removal apparatus that allows for "easy extraction" of the cork while still providing an adequate cork/glass seal that meets the four basic requirements outlined above. As used herein, "easy extraction" means that no cumbersome, awkward, or clumsy auxiliary equipment, such as cork screws that must be screwed into the cork by the consumer, "ahso"-type cork removers that require the consumer to insert a pair of blades between the cork and bottle, or air pumps that require the consumer to push a needle through the cork and pump air to increase pressure inside the bottle, and so on, is required of the consumer, and that adequate pulling forces are as easily applied as with conventional cork screws. The present invention satisfies those needs, as well as others, and overcomes the deficiencies of previously developed cork removal devices.

SUMMARY OF THE INVENTION

The foregoing needs are addressed by the present invention which generally comprises a cork anchor and an attached or detached cork-pulling handle that can withstand required pulling forces and that enables the consumer to use more than two fingers to pull the cork out of the bottle, thereby enabling the consumer to apply pulling forces just as large as those currently being used with prior art auxiliary cork screws. This in turn allows the wine producer to use conventional cork coatings that provide a good wine seal. In addition, the present invention will have little or no impact on the high-speed mechanized corking equipment widely used in the industry, and does not introduce means by which the wine can be contaminated.

By way of example, and not of limitation, the present invention generally comprises a composite cork and cork-removing unit having two components. One component is the cork, in which an anchor for a cork-pulling handle is secured. The second component is a cork-pulling handle which can be connected to the anchor by any of several means, and which can be stored with the bottle as a integral part of the bottle/capsule/label package, or can be supplied separately.

In accordance with one embodiment of the invention, the top of the anchor is approximately flush with the top of the cork. The top of the anchor contains an eye, or other female part of a latch, which can be hooked or otherwise connected to a male part of a latch, using the stem of a detached pulling handle which contains the hook or male latch at its end. The handle/stem combination can, as an example, resemble the basic T-shaped cork screw except, in place of a screw at the end of the stem, there is simply a hook. Also, the stem is joined to the handle with a hinged joint that allows the stem to be folded up against and co-linear with the handle. When folded into this compact storage configuration, the pulling handle can be stored against the side of the bottle, either parallel to the bottle axis, or congruent with the circumference of the bottle. When stored parallel to the axis, the placement can be either along the neck of the bottle or lower along the body (largest cylindrical part) of the bottle. In any of the storage positions, the handle can be secured with any of various conventional means such as a plastic ribbon around the bottle, with a quick release device like a rip tab that tears along a perforation.

In accordance with another embodiment of the invention, the top of the anchor is permanently connected to the stem or the lengthwise center of a pulling handle with a flexible cord or strap having adequate tensile strength to withstand a pulling force of approximately 40 kg. The pulling handle can be a separate handle that is stored in any of the positions described above, or it can be integrated with a wrapper (capsule) that covers the top part of the neck of the bottle so that the wrapper, designed with adequate stiffness and gripping length, becomes the pulling handle. The pull cord or strap is fastened to the anchor using any of numerous conventional methods. For example, one end of the cord could be looped through an eye at the top end of the anchor and then clamped to the cord. A similar connection can be made on the pulling handle. Alternatively, the pulling handle can be soft, rather than stiff (as needed when the cord is connected at the lengthwise center) in which case the cord would run through the handle, emerging from both ends. This latter approach also can be integrated with the wrapper as follows. By using two rip tabs co-linear with the bottle axis, separated from each other by 180°, and running the length of the wrapper, when the tabs are pulled the wrapper can be folded open into a handle perpendicular to the axis of the bottle and twice the length of the original wrapper. By using a folding crease across the disk-shaped top of the wrapper and extending between the two tops of the two rip-tab paths, the opening operation is facilitated. By threading a cord through the two pieces of this handle, and connecting it to the anchor so that the handle naturally rotates 180° as one prepares to pull the cord, we obtain a handle that comfortably fits the hand.

In accordance with still another embodiment of the invention, the bottle-neck wrapper is integrated with the pulling handle, but there is no cord involved and there is no connection operation to be performed by the consumer. Rather, the connection between the anchor in the cork and the pulling handle is made when the handle/wrapper combination is applied to the bottle during production. For example, from the operational position, the handle can be foldable in one direction, so that it can be wrapped over the top of the bottle, but not foldable in the opposite direction so that, in the operational position, the handle is stiff enough to enable the user to execute the necessary pull using a three- or four-finger grip.

More generally, essentially any type of cork-pulling device can be can be used in this invention by providing a means, such as a hook or latch, for attaching the cork-pulling handle to the anchor in the cork. This includes lever-type pullers and geared pullers.

An object of the invention is to provide for the easy and convenient removal of a cork from a bottle.

Another object of the invention is to provide a cork removal apparatus that is packaged with a bottle.

Another object of the invention is to avoid the requirement that the consumer perform the operation of anchoring a pulling device to the cork.

Another object of the invention is to avoid the requirement that the consumer force a device through, or into, or along the sides of the cork.

Another object of the invention is to require from the consumer, little more than a simple straight pulling operation in order to uncork the bottle.

Another object of the invention is to avoid requiring that the consumer unscrew a corkscrew from the cork after removal.

Another object of the invention is to provide a cork removal apparatus that is disposable.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
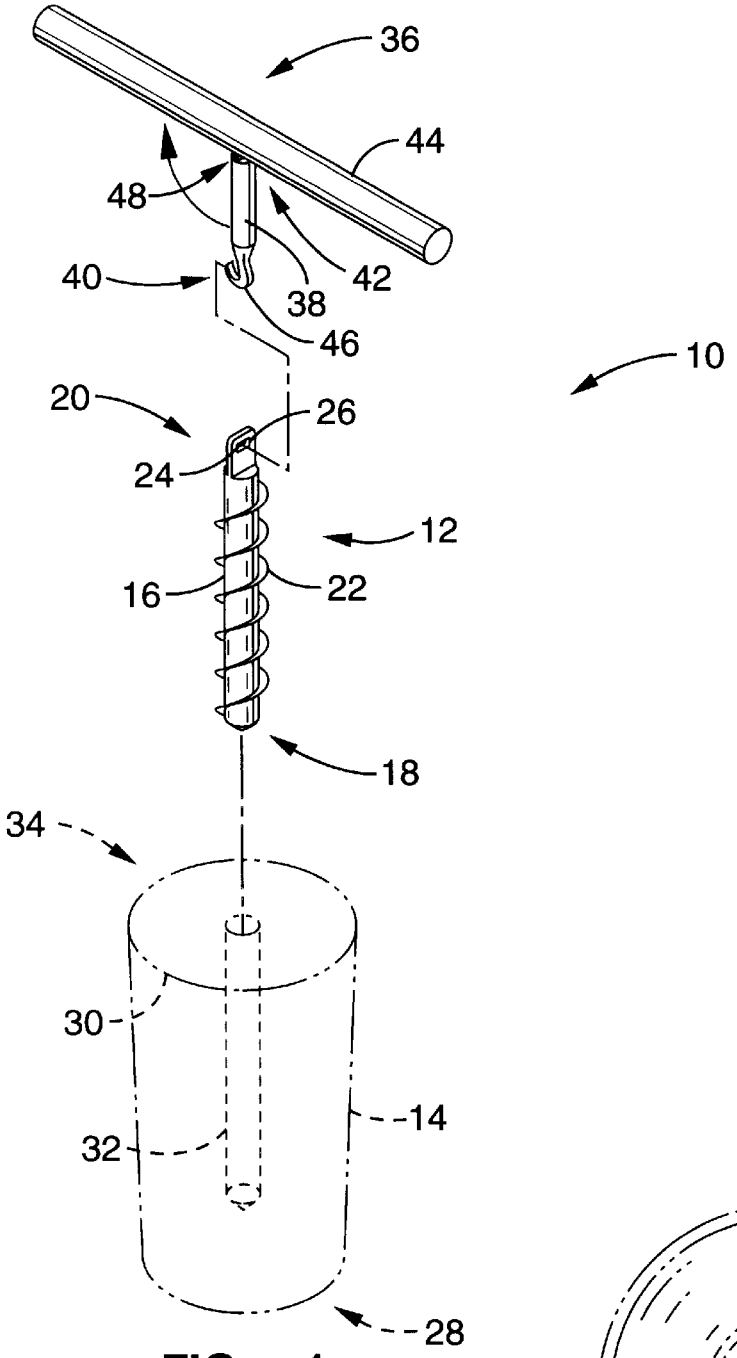
FIG. 1 is an exploded view of a cork removal apparatus in accordance with the present invention shown in combination with a cork depicted in phantom.

Referring more specifically to the drawings, for illustrative purposes the present invention is embodied in the apparatus generally shown in FIG. 1 through FIG. 11, where like reference numerals denote like parts. It will be appreciated that the apparatus may vary as to configuration and as to details of the parts without departing from the basic concepts as disclosed herein.

Referring first to FIG. 1, a cork removal apparatus 10 in accordance with the present invention includes an anchor 12 which is configured to be embedded into a cork 14. As used herein, the term "cork" means natural or synthetic corks, including plastic corks and the like. Anchor 12 comprises an elongated cylindrical-shaped shank 16 having first and second ends 18, 20, respectively, and spiral threads 22 around the circumference of shank 16 extending between first and second ends 18,20. Shank 16 may or may not be tapered toward distal end 18, and the proximal end 20 includes an eye 24 which provides an opening 26 therein.

Because anchor 12 will remain in cork 14 for long periods of time when wine is being stored, the integrity of cork 14 must not be compromised by insertion of anchor 12. Consequently, the bottom 28 and outside circumference 30 of cork 14 must not be broken through. Also, little or no tearing or splitting should occur in the interior of cork 14. Thus, conventional screw designs will not suffice for anchor 12.

The preferred manner of meeting the foregoing requirements, while insuring that anchor 12 is sufficiently secured in cork 14 to withstand a pulling force of approximately 40 kg, is to take advantage of the normal corking process in which the cork is compressed radially approximately 4 mm. To do this, a pilot hole 32 approximately 3 mm to 5 mm in diameter is drilled at the center of the top 34 of cork 14, and down the longitudinal axis to approximately 6 mm from the bottom 28 of cork 14. Additionally, threads 22 should be dull to prevent or minimize cutting of the cork as the anchor is screwed into place and afterward when the cork is compressed. Also, to minimize or prevent cork 14 from splitting adjacent to the protruding threads 22 when the cork is compressed, the overall diameter of shank 16 and threads 22 should not exceed approximately 7 mm where pilot hole 32 is in the range of approximately 3 mm to 5 mm. Preferably, for a pilot hole diameter in this range, the diameter of shank 16 should be approximately 3 mm and the protrusion of threads 22 from shank 16 should not exceed approximately 2 mm on each side of the shank. Furthermore, to prevent or minimize cork tearing between the threads when anchor 12 is pulled on, there should be approximately 8 mm of separation between threads. In this manner, anchor 12 is specially designed so that it can be screwed into pilot hole 32 prior to compression of the cork with minimal force being exerted against the inside wall of the pilot hole so as not to tear or split the cork. It will be appreciated that the exact dimensions to be used can be adjusted to accommodate the desired range of cork grades.

With regard to production and assembly, cork 14 must be drilled and anchor 12 screwed into the drilled pilot hole 32 prior to corking the bottle. The overall length of anchor 12 is selected so that eye 24 will be generally flush with top 34 of cork 14 when it is screwed into pilot hole 32 and bottoms out. The normal corking process, which involves compressing cork 14, then secures anchor 12 in cork 14 to form an integral cork/anchor assembly. While threads 22 are preferred for securing anchor 12 to cork 14, other means for securing the two are contemplated, including barbs, ribs, protrusions and the like.

To facilitate removal of cork 14 once the bottle is corked, a cork-pulling handle 36 is provided which can be connected to anchor 12 by any of several methods, and which can be stored with or separately from the bottle. In FIG. 1, cork-pulling handle 36 is shown as comprising an elongated stem 38 having first and second ends 40, 42, respectively, and an elongated handle 44 coupled to the proximal end 42 of stem 38. Located at distal end 40 is an arcuate hook 46 that is configured to be received through opening 26 in eye 24 of anchor 12. The handle/stem combination can, as an example, resemble the basic T-shaped cork screw except that, in place of a screw at the end of the stem, there is simply a hook. Handle 44 should be sufficiently long to accommodate at least a two-finger grip and preferably a three- or four-finger grip. It will also be appreciated that hook 46 and eye 24 are only examples of coupling mechanisms that could be employed, and that other means of coupling cork-pulling handle 36 to anchor 12 could be substituted. When hook 46 engages eye 24 and a pulling force is applied along the longitudinal axis of stem 38, cork 14 can be removed from the bottle.

Figure 2:
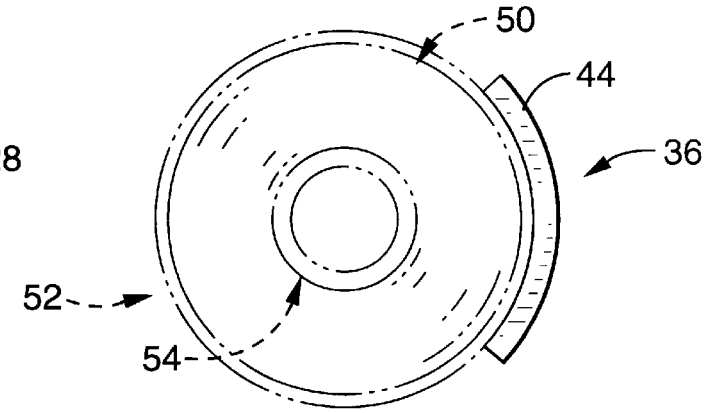
FIG. 2 is a top plan view of a bottle showing the cork-pulling handle portion of the apparatus shown in FIG. 1 stored along the circumferential shoulder portion of the bottle.
Figure 3:
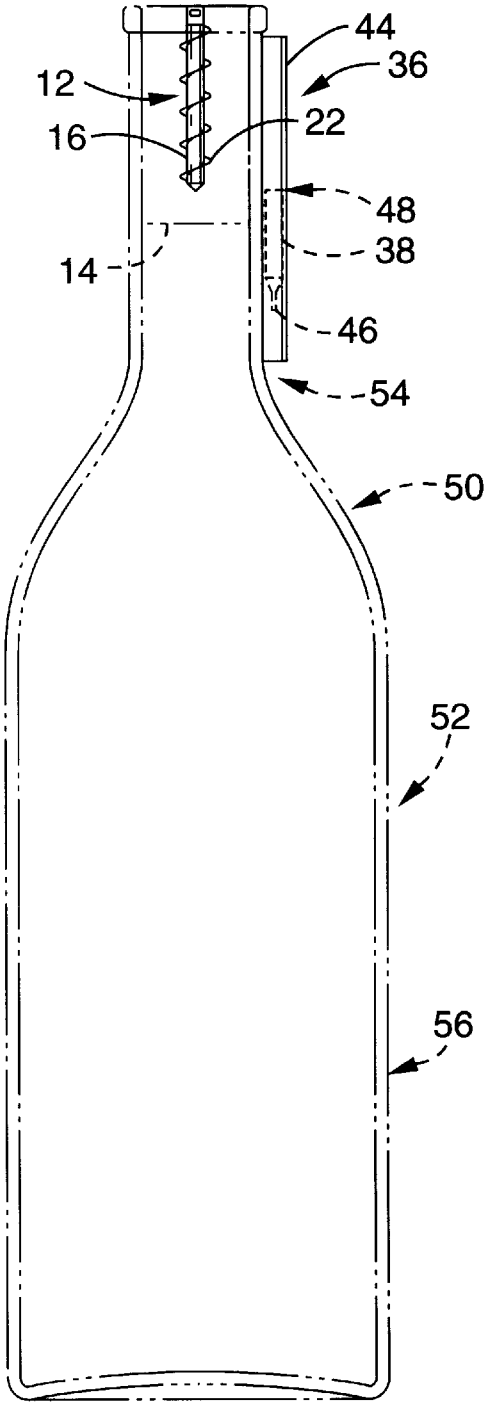
FIG. 3 is side elevational view of a bottle showing the cork-pulling handle portion of the apparatus shown in FIG. 1 stored along the neck portion of the bottle.
Figure 4:
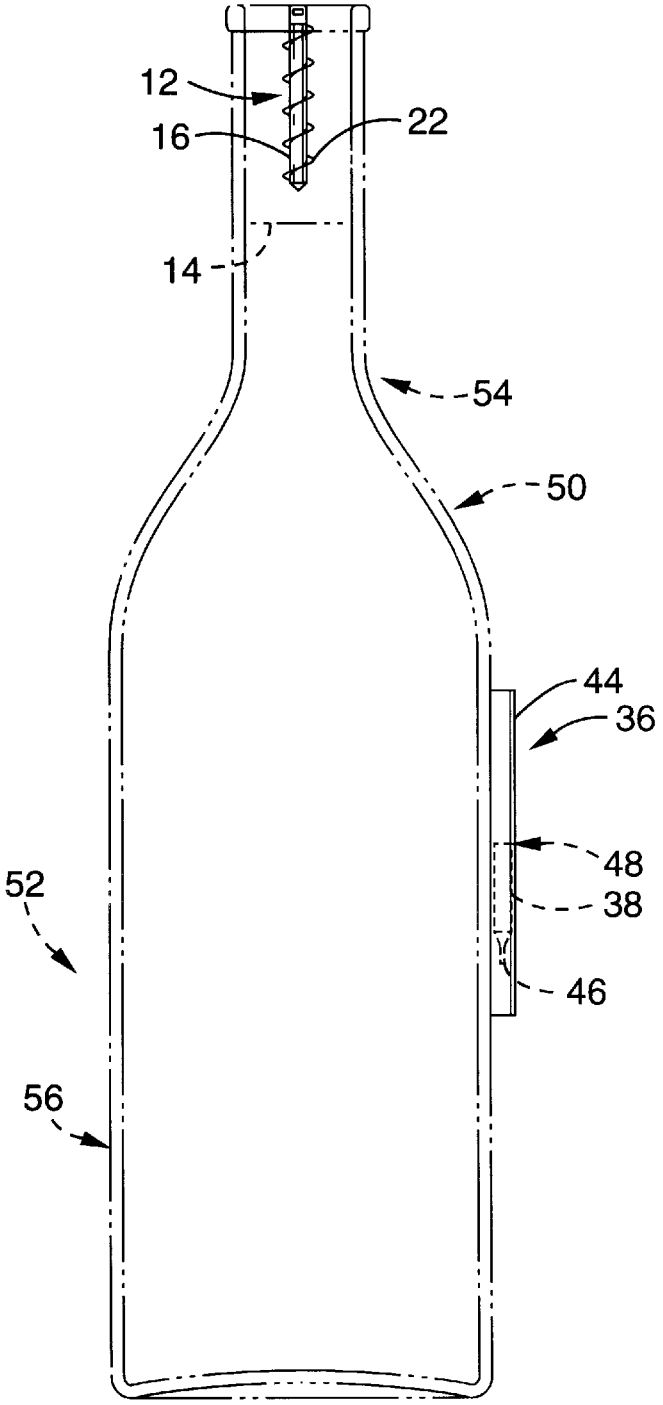
FIG. 4 is side elevational view of a bottle showing the cork-pulling handle portion of the apparatus shown in FIG. 1 stored along the body portion of the bottle.

In order to facilitate packaging cork-pulling handle 36 with a wine bottle in a convenient and aesthetically pleasing manner, stem 38 is preferably coupled to handle 44 with a hinged joint 48 of a conventional type that allows stem 38 to be folded up against and co-linear with handle 44. When folded into this compact storage configuration, cork-pulling handle 36 can be stored against the side of the bottle, either parallel to the longitudinal axis of the bottle, or congruent with the circumference of the bottle. When stored congruent with the circumferential shoulder 50 of the bottle 52 as shown in FIG. 2, it may be desirable to make stem 38 and handle 44 slightly arcuate to follow the contour of the bottle. When stored parallel to the axis, the placement can be either along a flat portion of the neck 54 of bottle 52 or along a flat portion of the body 56 (largest cylindrical part) of bottle 52, as shown in FIG. 3 and FIG. 4, respectively. Other storage positions on the bottle will be readily apparent. In any of the storage positions, cork-pulling handle 36 can be secured with any of various conventional means such as a plastic ribbon (not shown) around the bottle, with a quick release device like a rip tab (not shown) that tears along a perforation.

Figure 5:
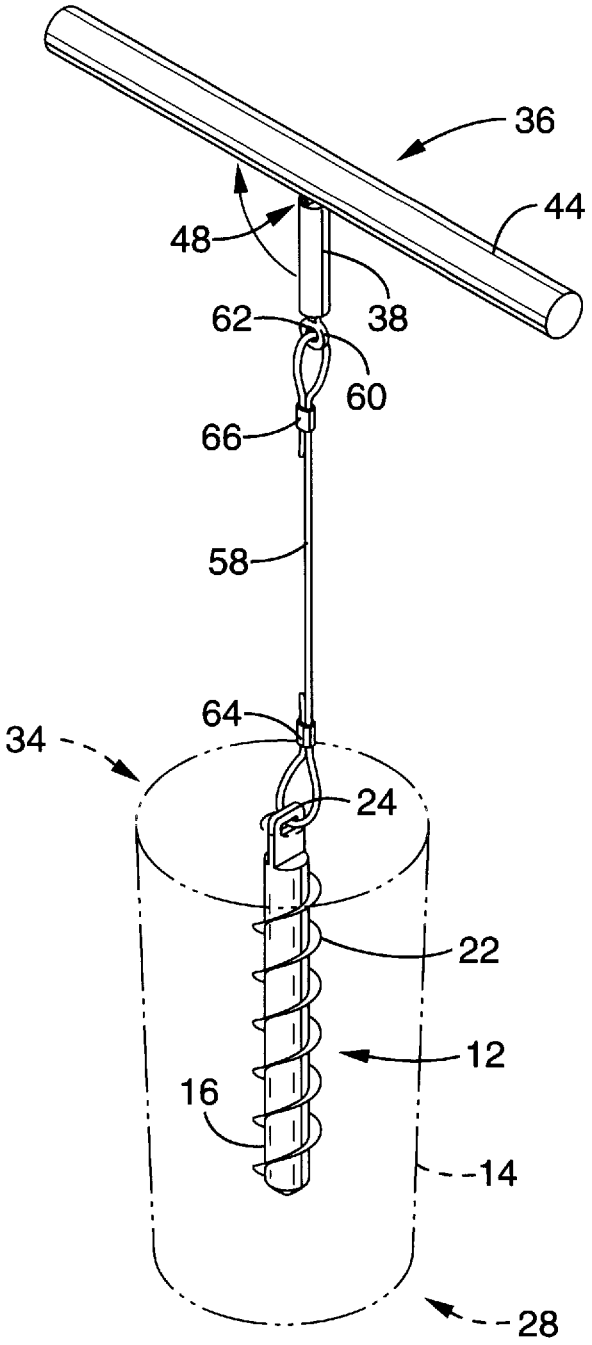
FIG. 5 is a side assembled view of an alternative embodiment of the cork removal apparatus shown in FIG. 1 in which the handle portion of the apparatus is coupled to the cork anchor portion using a cord.

Referring now to FIG. 5, an alternative embodiment of the invention is shown in which a flexible cord or strap 58 having an adequate tensile strength to withstand a pulling force of approximately 40 kg is used to permanently couple anchor 12 to cork-pulling handle 36. In the embodiment shown, hook 46 has been replaced with an eye 60 having an opening 62. One end of cord 58 is threaded through eye 24 in anchor 12 and held in place with a conventional cord clamp 64 or like fastener. Similarly, the end of cord 58 is threaded through eye 60 of cork-pulling handle 36 and held in place with cord clamp 66 or like fastener. It will also be appreciated that other types of connectors could be substituted for eye 24 and eye 60 in this embodiment, and that other conventional means for coupling anchor 12 to cork-pulling handle 36 could be used as well, including chains and flexible cables. It will also be appreciated that cork-pulling handle 36 can stored in any of the positions shown in FIG. 2 through FIG. 4, with cord 58 and cork-pulling handle 36 secured to the bottle in the same manner described above.

Figure 6:
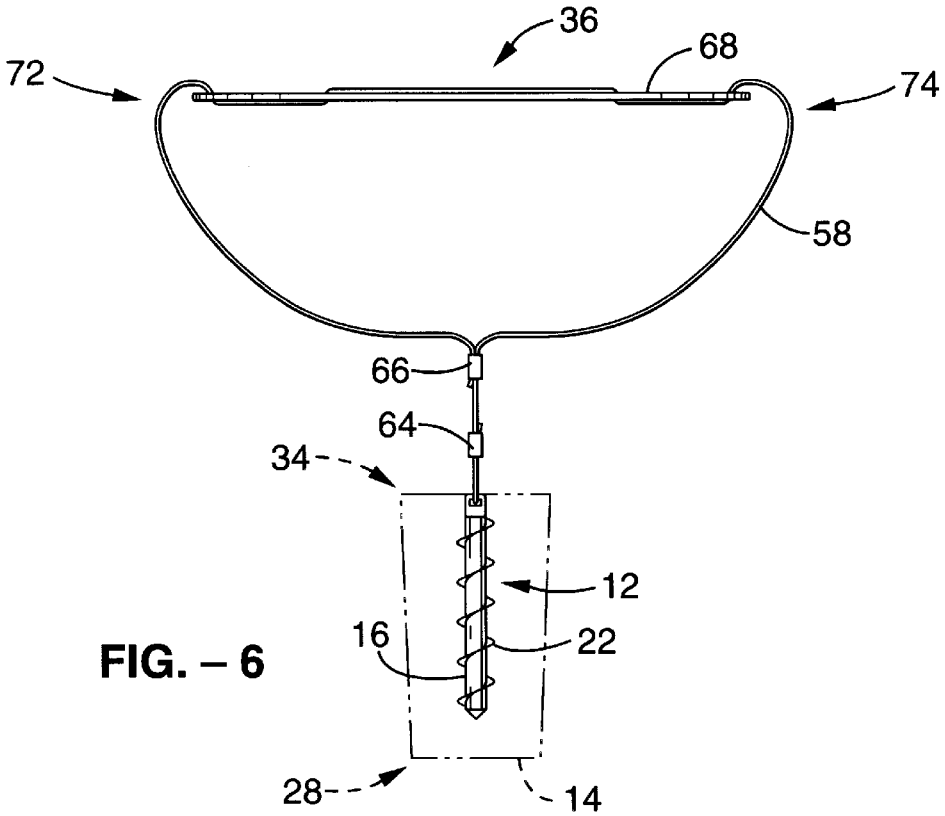
FIG. 6 is a side elevation view of an alternative embodiment of the cork-pulling handle shown in FIG. 5.
Figure 7:
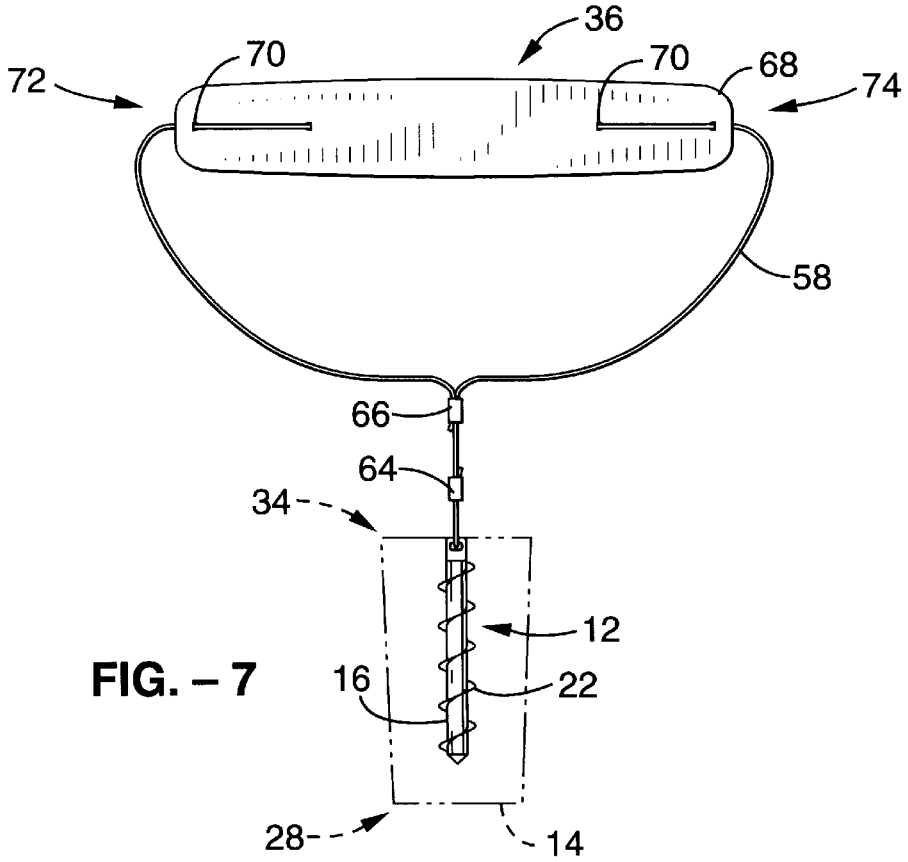
FIG. 7 is a top plan view of the cork-pulling handle shown in FIG. 6.

Referring now to FIG. 6 and FIG. 7, an alternative embodiment of cork-pulling handle 36 is shown. In this embodiment, cork-pulling handle 36 comprises an elongated generally flat handle 68 having a plurality of openings 70 along the central longitudinal axis of handle 68 through which cord 58 is threaded so that it emerges from ends 72, 74 as shown. This embodiment is particularly well suited for storage of cork-pulling handle congruent to shoulder 50 of bottle 52 as shown in FIG. 2, in which case it may be desirable to make handle 68 flexible or slightly arcuate to fit the contour of the bottle. Note that, in this embodiment, handle 68 easily rotates and fits comfortably in the user's hand.

Figure 8:
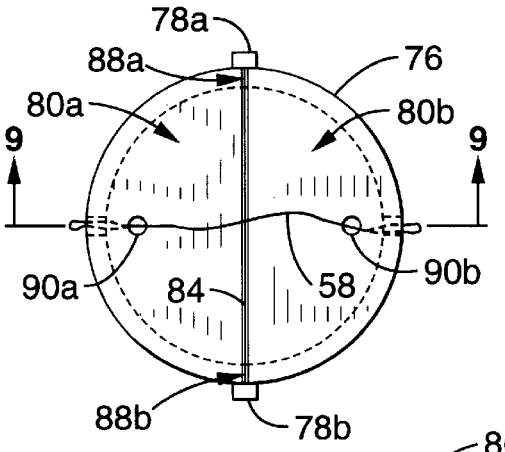
FIG. 8 is a top plan view of an alternative embodiment of the cork-pulling handle shown in FIG. 6 in which the cork-pulling handle is integrated with the bottle neck wrapper.
Figure 9:
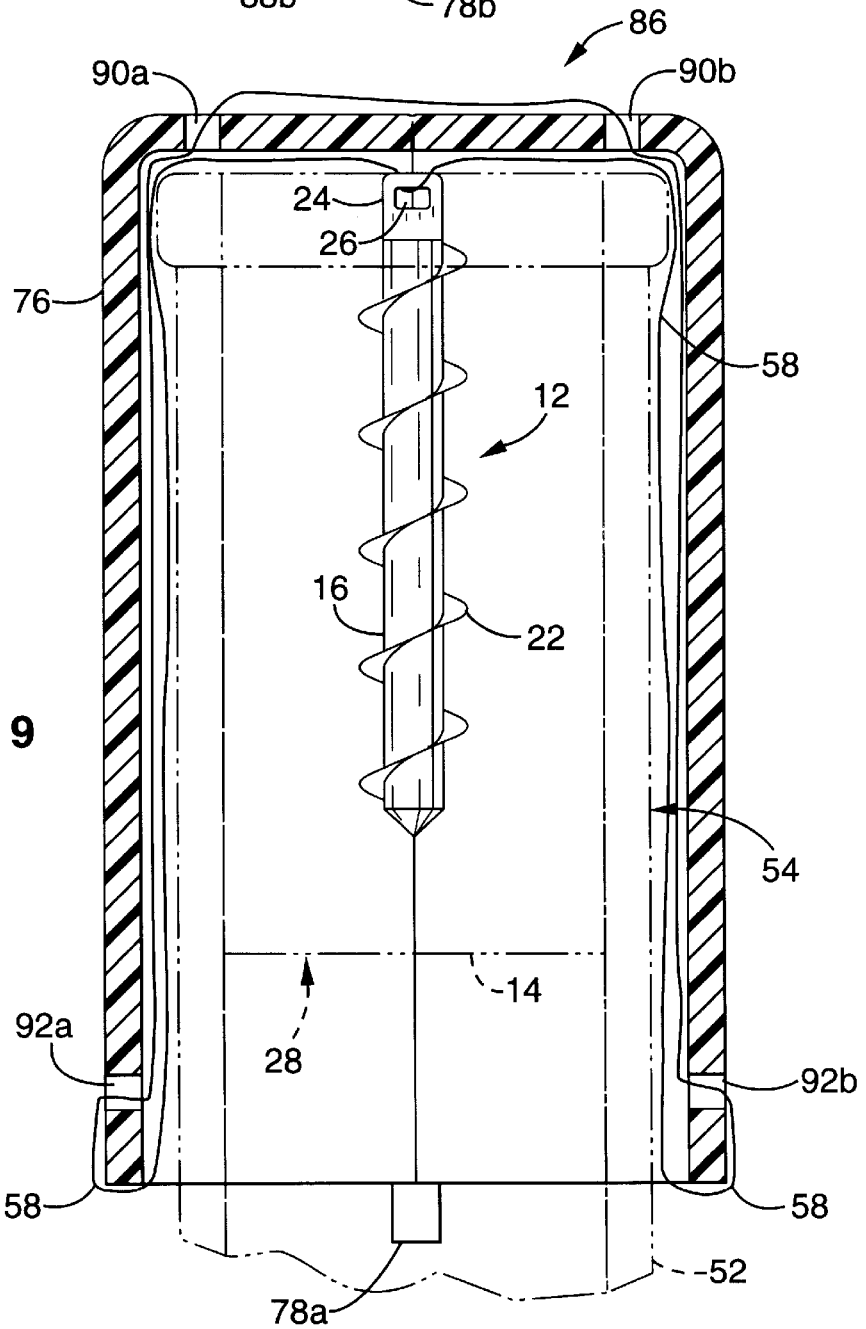
FIG. 9 is a cross-section view of the integrated wrapper/cork-pulling handle shown in FIG. 8 taken through line 9—9.
Figure 10:
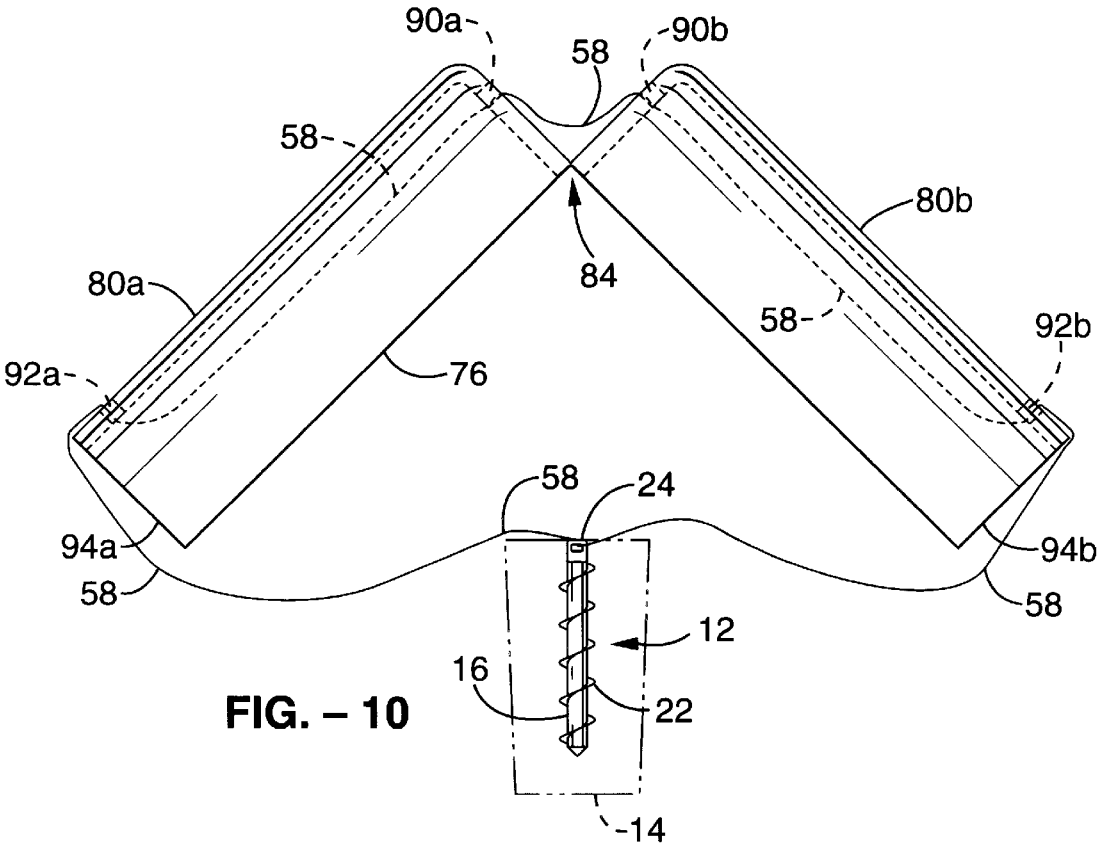
FIG. 10 is a side elevation view of the integrated wrapper/cork-pulling handle of FIG. 8 and FIG. 9 shown in a partially open position.
Figure 11:
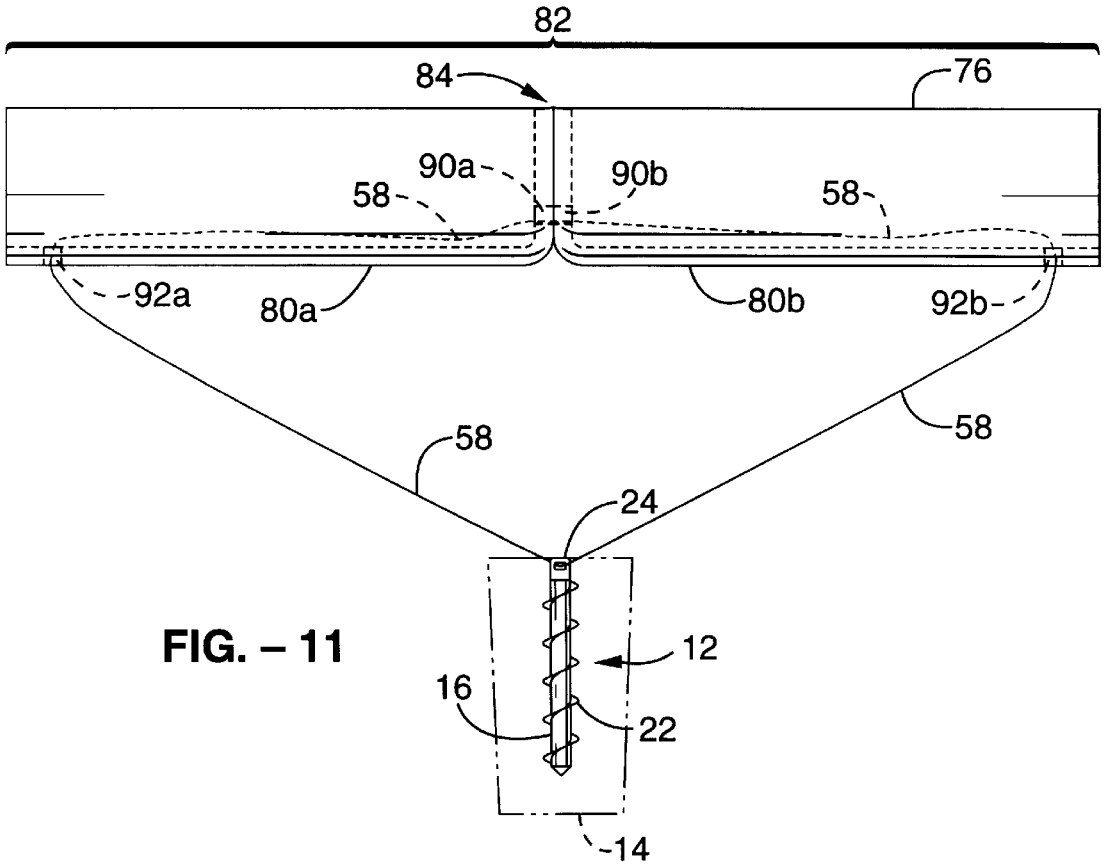
FIG. 11 is a side elevation view of the integrated wrapper/cork-pulling handle of FIG. 8 and FIG. 9 shown in a fully open position.

Referring now to FIG. 8 through FIG. 11, cork-pulling handle 36 can also be integrated with a wrapper (capsule) 76 that covers the top part of neck 54 of bottle 52 so that the wrapper itself, designed with adequate stiffness and gripping length, becomes the pulling handle. Here, wrapper 76 includes two rip tabs 78*a*, 78*b* that are co-linear with the bottle axis, separated from each other by 180°, and run the length of wrapper 76 as shown in FIG. 9. When tabs 78*a*, 78*b* are pulled, wrapper 76 is split into two sections 80*a*, 80*b* that can be folded open into a handle 82 perpendicular to the axis of the bottle and twice the length of the original wrapper, as shown in FIG. 10 and FIG. 11. By using a folding crease 84 across the disk-shaped top 86 of wrapper 76 extending between the two upper ends 88*a*, 88*b* of the two rip-tab paths as shown in FIG. 8, the opening operation is facilitated. By threading cord 58 through openings 90*a*, 90*b* in sections 80*a*, 80*b*, respectively, in the top 86 of wrapper 76 (FIG. 8), as well as through openings 92*a*, 92*b* in the bottom ends 94*a*, 94*b* of sections 80*a, b*, respectively, of wrapper 76 (FIG. 9), and threading it through eye 24 in anchor 12 in the manner shown in FIG. 10 and FIG. 11, the handle will naturally rotate 180° as one prepares to pull the cord, and the handle will fit comfortably in the user's hand and operate similar to handle 68 shown in FIG. 6 and FIG. 7.

Another alternative is to integrate the bottle-neck wrapper with cork-pulling handle as described above, but not use a cord or require a connection operation to be performed by the consumer. Here, the connection between anchor 12 in cork 14 and cork-pulling handle 36 would be directly made when the handle/wrapper combination is applied to the bottle during production. For example, from the operational position, the handle can be foldable in one direction, so that it can be wrapped over the top of the bottle, but not foldable in the opposite direction so that, in the operational position, the handle is stiff enough to enable the user to execute the necessary pull using a three- or four-finger grip.

With regard to production and assembly, the cork must be drilled and the anchor screwed into the drilled hole prior to corking the bottle. The normal corking process, which involves compressing the cork, then secures the anchor in the cork. Then either during or prior to or possibly even after applying the wrapper to the neck of the bottle, the cork-pulling handle is attached to the bottle for storage. In the embodiments where a cord or the like is used to couple anchor 12 and cork-pulling handle 36, the intermediate operation of connecting the cord to the anchor and cork-pulling handle would be required.

The anchor and cork-pulling handle can be constructed from metal or, preferably, a medium-hard polyester resin, such as polyethylene or similar material that can be used in an injection mold. Alternatively, the handle portion can be made from softer more flexible material if desired. This material need withstand only one use, unlike a conventional auxiliary cork screw. The cord can be fishing line, cord material, cable, chains or other flexible material that has a tensile strength rating of approximately 40 kg.

Accordingly, it will be seen that this invention provides an integrated cork stopper/anchor assembly for a wine bottle or the like that can be removed using a cork-pulling handle packaged with the bottle or provided separately. The anchor can be installed in any type of cork, natural or synthetic, including plastic corks and the like. The cork-pulling handle is completely separate from the cork stopper/anchor assembly, can be coupled to the anchor using hook and eye couplers or the like which require the consumer to make the connection. Alternatively, the cork-pulling handle can be permanently connected to the anchor using cords, straps and the like. The cork pulling handle can be tied or otherwise secured to the bottle, or can be integrated with the wrapper or capsule that covers the neck of the bottle and seals the cork. In addition, the cork-pulling handle can be a completely separate detached component that is sold separately if desired. As can be seen from the discussion herein, the present invention provides for the quick and easy removal of a cork from a bottle without having to engage the cork with a separate corkscrew or other cork removal device. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A self-contained cork stopper and cork-pulling apparatus for cork-sealed bottles, comprising:

(a) a cork stopper, said cork stopper including a top and a bottom and at least one side;

(b) an anchor, said anchor including a threaded shank internally secured in said cork stopper and forming an integrated cork stopper/anchor assembly, wherein said anchor does not extend beyond said bottom of said cork stopper or protrude through the side of said cork stopper;

(c) a cork-pulling handle, said cork-pulling handle capable of being stored separately from said cork stopper/anchor assembly, said cork-pulling handle capable of being grasped by more than two fingers of a user to apply force for removal of said cork stopper; and (d) coupling means for coupling said cork-pulling handle to said anchor.

2. An apparatus as recited in claim 1, wherein said cork stopper includes an internal pilot hole, wherein said anchor and threaded shank are received by said pilot hole, and wherein said anchor is secured to said cork stopper during compression of said cork stopper during corking of a bottle sealed by said cork stopper/anchor assembly.

3. An apparatus as recited in claim 1, wherein said cork-pulling handle is configured for attachment to a bottle sealed by said integrated cork stopper/anchor assembly for storage.

4. An apparatus for removing a cork from a bottle, comprising:

(a) a cork-pulling handle;

(b) an anchor capable of being inserting into and engaging a cork, said anchor including a threaded shank for inserting into and engaging said cork, said cork including a top and a bottom, wherein said anchor is substantially flush with said top and does not inhibit breathing of said cork, and wherein said anchor does not extend beyond said bottom;

(c) anchor engaging means attached to said cork-pulling handle for engaging said anchor in an integrated cork/anchor assembly; and (d) wherein said cork-pulling handle is separate and detached from said cork/anchor assembly.

5. An apparatus as recited in claim 4, wherein said anchor and said threaded shank are received by a pilot hole in said cork, and wherein said anchor is secured to said cork during compression of said cork.

6. An apparatus as recited in claim 4, wherein said cork-pulling handle is configured for attachment to a bottle sealed by said integrated cork/anchor assembly for storage.

7. An apparatus as recited in claim 4, further comprising means for permanently coupling said anchor engaging means to said anchor.

8. An apparatus for removing a cork from a cork-sealed bottle, comprising:

(a) an anchor, said anchor including a threaded shank for securing said anchor to a cork to produce an integrated cork/anchor assembly, said cork including a top and a bottom, wherein said anchor is substantially flush with said top and does not inhibit breathing of said cork, and wherein said anchor does not extend beyond said bottom;

(b) a cork-pulling handle, said cork-pulling handle including means for engaging said anchor; and (c) wherein said pulling handle can be stored separately from said anchor and said cork.

9. An apparatus as recited in claim 8, wherein said threaded shank is received by a pilot hole in said cork, and wherein said anchor is secured to said cork during compression of said cork.

10. An apparatus as recited in claim 8, wherein said cork-pulling handle is configured for attachment to a bottle sealed by said integrated cork/anchor assembly for storage.

11. An apparatus as recited in claim 8, further comprising means for permanently coupling said anchor engaging means to said anchor.

* * * * *